US009562273B2

(12) United States Patent
Poloni

(10) Patent No.: US 9,562,273 B2
(45) Date of Patent: Feb. 7, 2017

(54) TILTING CONVERTER

(71) Applicant: Danieli & C. Officine Meccaniche S.P.A., Buttrio (IT)

(72) Inventor: Alfredo Poloni, Fogliano Redipuglia (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 243 days.

(21) Appl. No.: 14/155,121

(22) Filed: Jan. 14, 2014

(65) Prior Publication Data

US 2014/0197584 A1 Jul. 17, 2014

(30) Foreign Application Priority Data

Jan. 15, 2013 (IT) ..... MI2013A0046

(51) Int. Cl.

| | |
|---|---|
| ***C21C 5/50*** | (2006.01) |
| ***C21C 5/46*** | (2006.01) |
| ***F27B 3/06*** | (2006.01) |
| ***F27B 7/20*** | (2006.01) |
| ***F27B 14/02*** | (2006.01) |

(52) U.S. Cl.

CPC ..... *C21C 5/50* (2013.01); *C21C 5/4633* (2013.01); *F27B 3/065* (2013.01); *F27B 7/2083* (2013.01); *F27B 14/02* (2013.01)

(58) Field of Classification Search

CPC ..... C21C 5/50

See application file for complete search history.

(56) References Cited

U.S. PATENT DOCUMENTS

| | | | |
|---|---|---|---|
| 3,561,709 | A | 2/1971 | Bornscheuer |
| 5,364,079 | A | 11/1994 | Gruber et al. |
| 2012/0223107 | A1 | 9/2012 | Best et al. |

FOREIGN PATENT DOCUMENTS

| | | | | |
|---|---|---|---|---|
| GB | 2492735 | | 9/2013 | |
| WO | WO2012114294 | | 8/2012 | |
| WO | WO 2013/008158 | * | 1/2013 | ..... C21C 5/42 |

OTHER PUBLICATIONS

Manfred Eysn and Gunther Staudinger, "VAI-Con Link Suspension System for LB/BOF Vessels", Iron and Steel Engineer, Nov. 1966, pp. 13-16.

* cited by examiner

*Primary Examiner* — Lois Zheng

(74) *Attorney, Agent, or Firm* — Stetina Brunda Garred & Brucker

(57) ABSTRACT

A tilting converter comprising a container (2), defining a first longitudinal axis X, having a bottom (2'); a support ring (3), coaxial to the container (2) and distanced from said container, provided with two diametrically opposite supporting pins (6), defining a second axis Y orthogonal to the first axis X, adapted to allow a rotation of the converter about said second axis Y; a suspension system, connecting said container (2) to said support ring (3), comprising groups (12) of first suspension devices (7), said groups (12) being arranged substantially equidistant to each other along a cylindrical side surface coaxial to the first axis X, in a position between the support ring (3) and the bottom (2'); each of said first suspension devices (7) being provided with a plurality of longitudinal elastic elements, each longitudinal elastic element being arranged alongside the next so as to define a laying plane, and a gap (15, 15') is provided between one longitudinal elastic element and the next.

11 Claims, 6 Drawing Sheets

TILTING CONVERTER

CROSS REFERENCE TO RELATED APPLICATIONS

The present application claims priority to Italian Patent Application No. MI2013A000046 filed Jan. 15, 2013.

STATEMENT RE: FEDERALLY SPONSORED RESEARCH/DEVELOPMENT

Not Applicable.

BACKGROUND OF THE INVENTION

Field of the Invention

The present invention relates to a tilting oxygen converter provided with a suspension system of the container of the converter connecting said container to a support ring.

State of the Art

The main object of an oxygen converter is to convert the cast iron produced in the furnace into raw liquid steel, which may be subsequently refined in the secondary steel production department.

The main functions of the oxygen converter, also known as B.O.F. (Basic Oxygen Furnace), are to decarburize and remove phosphorous from the cast iron and to optimize the temperature of the steel so that further treatments may be carried out before casting with minimum heating and cooling of the steel.

The exothermal oxidation reactions which are generated in the converter produce a great deal of thermal energy, more than that needed to reach the established temperature of the steel. This extra heat is used to melt scrap and/or additions of ferrous material. The B.O.F. container, being substantially a furnace, is also subject to high thermal expansions.

The converter consists of a container, defining the reactor and having a substantially cylindrical shape, supported by a support ring, surrounding the container and appropriately distanced therefrom, provided with two diametrically opposite supporting pins, all supported by two supports anchored to the ground. The rotating control of the container is fitted onto one of the two supporting pins.

An example of oxygen converter of the prior art is described in WO2008/092488A1. The container of such a converter is supported by means of an outer support ring and a plurality of suspension elements connecting said container to said support ring, the suspension elements being restrained at a first end to the container and at a second end to the support ring.

First suspension elements are formed by packs of lamellae which are arranged in a distributed manner under the support ring, considering the converter in its upright position with the loading mouth facing upwards. One end of the packs of lamellae is fixed onto a lower surface of the support ring; the other end of the packs of lamellae is fixed to a lower frustoconical portion of the container. In such a configuration, the packs of lamellae are arranged inclined by an angle of approximately 20-25° with respect to a respective vertical plane containing the longitudinal axis defined by the converter.

Second suspension elements are formed instead by pendulum rods, which are hinged at one end to the support ring and at the other end to the container. Considering the conveyor in its upright position with the loading mouth facing upwards, such pendulum rods are arranged horizontally at the two supporting pins above and under the support ring.

Disadvantageously, in the packs of lamellae made and arranged in the manner described above, excessively concentrated loads are created at the fastening points of the lamellae to the support ring and to the structure of the container of the converter. In particular, such packs of lamellae so configured are transversally rigid and do not allow the flexion and torsion of the lamellae themselves, and thus the redistribution of the stresses when the converter is turned by 90° from its vertical position to carry out the step of tapping.

Furthermore, the different thermal expansion of the container and of the support ring determines high concentrated loads in the fastening points of the lamellae due to the fact that the attachment of the lamellae themselves on the container tends to shift because it expands more, while the attachment of the lamellae on the support ring tends to remain in position because it expands less.

Another example of oxygen converter of the prior art, similar to that disclosed in WO2008/092488A1 (FIG. 1a), is described in US2012/0223107A1 (FIG. 3).

A further example of oxygen converter of the prior art is disclosed in GB2492735. In this converter the converter vessel or container is secured to the trunnion ring by means of a plurality of connecting elements, and each connecting element is rigidly secured by means of its opposing ends to the underside of the trunnion ring at one end and to the converter vessel at the other end. Each connecting element comprises precisely one lamella which is shielded from the converter vessel by means of a protective element that is connected by means of its opposing ends both to the converter vessel and to the trunnion ring, but only one of these ends is rigidly connected either to the trunnion ring or to the converter vessel. Therefore said protective element does not itself have any bearing function. Each lamella defines an own laying plane that is clearly different from the laying plane of the adjacent lamellae, being each lamella distanced from the adjacent ones and fixed in an area of the converter angularly distanced from the fixing areas of the adjacent lamellae. Moreover each lamella has respective distinct fastening supports. Even if this solution allows to slightly reduce the concentrated loads at the fastening points of the lamellae, it is still felt the need to make a tilting converter which allows to better overcome the aforesaid drawbacks.

The centering between container and support ring is also important to suitably allow deformations or thermal expansions of the container caused by the high temperatures reached during the refining process.

SUMMARY OF THE INVENTION

It is the main object of the present invention to make an alternative solution of oxygen converter provided with a suspension system of the container, connecting said container to the support ring thereof, which allows to further reduce excessively concentrated loads at the fastening points of the suspension devices to the support ring and to the structure of the container of the converter.

Another object of the invention is to make an oxygen converter in which the suspension system of the container can adapt to the various operative positions thereof, even the most demanding, which occur, for example, during the rotation of the container without overloads and absorbing the stresses which are generated.

A further object of the invention is to make an oxygen converter provided with a suspension system of the container which does not require maintenance, allowing to eliminate routine and supplementary interventions and eliminating the replacement of the elements subject to wear.

The present invention, therefore, suggests to reach the objects illustrated above by making a tilting converter which, in accordance with claim 1, comprises:

a container, defining a first longitudinal axis X, having a bottom;

a support ring, coaxial to the container and distanced from said container, provided with two diametrically opposite supporting pins, defining a second axis Y orthogonal to the first axis X, adapted to allow a rotation of the converter about said second axis Y;

a suspension system, connecting said container to said support ring, comprising groups of first suspension devices, said groups being arranged substantially equidistant to each other at a cylindrical side surface coaxial to the first axis X, in a position between the support ring and the bottom, characterised in that each of said first suspension devices is provided with a plurality of longitudinal elastic elements rigidly connected by means of their opposing ends to the container and to the support ring respectively, each longitudinal elastic element being arranged alongside the next so as to define a single laying plane for each of said first suspension devices of each group, and a gap is provided between one longitudinal elastic element and the next one in each of said suspension devices of each group.

Advantageously, each first suspension device, or vertical suspension device considering the converter with its mouth facing upwards, consists of a plurality of longitudinal elastic elements arranged close to one another which mutually cooperate in absorbing and redistributing loads. A predetermined gap is provided between one elastic element and the next, preferably of the same entity for all elements. Said longitudinal elastic elements are adapted to work under flexion and torsion when the converter is turned by 90° for the step of tapping (horizontal position) from the upright position with the loading mouth facing upwards (vertical position).

According to a variant, the first suspension devices are arranged parallel to axis X, i.e. arranged vertically, so as to allow a greater passage of air between the devices themselves and the container for a better cooling of the container.

According to another variant, the first suspension devices are arranged inclined with respect to the axis X, preferably by an angle equal to approximately 10-20°, so that the suspension system has a greater self-centering effect for the container.

The vertical suspension system of the converter, object of the present invention, has the following advantages:

- it allows to redistribute stresses when the B.O.F. is turned by 90° for the step of tapping (horizontal position) avoiding excessive loads concentrated at the fastening points of the first suspension devices to the support ring and to the B.O.F. container;
- it allows to easily absorb the thermal expansions of the container with respect to the support ring;
- it effectively absorbs vibrations which are generated during the blowing of oxygen into the container;
- it effectively absorbs the forces generated by the inertia of the container at the beginning and end of its rotation;
- it does not require any maintenance with respect to traditional systems which use ball joints and pins subject to wear, with saving in terms of maintenance hours and plant downtime;
- it maintains the container centered with respect to the support ring with high accuracy in all conditions of inclination;
- it is suitable for converters of all sizes.

The excellent centering between container and support ring allows the thermal expansions of the container caused by the high temperatures reached during the conversion process.

A further advantage is determined in that the entire structure of the converter, including protrusions, is configured so as to be inscribed within a sphere, the radius of which is determined by layout requirements of the plant comprising the converter.

The dependent claims describe preferred embodiments of the invention.

BRIEF DESCRIPTION OF THE DRAWINGS

Further features and advantages of the present invention will be apparent in light of the detailed description of a preferred, but not exclusive, embodiments of an oxygen converter illustrated by way of non-limitative example, with reference to the accompanying drawings, in which.

The same reference numbers in the figures identify the same elements.

DETAILED DESCRIPTION OF THE INVENTION

Figure 1:
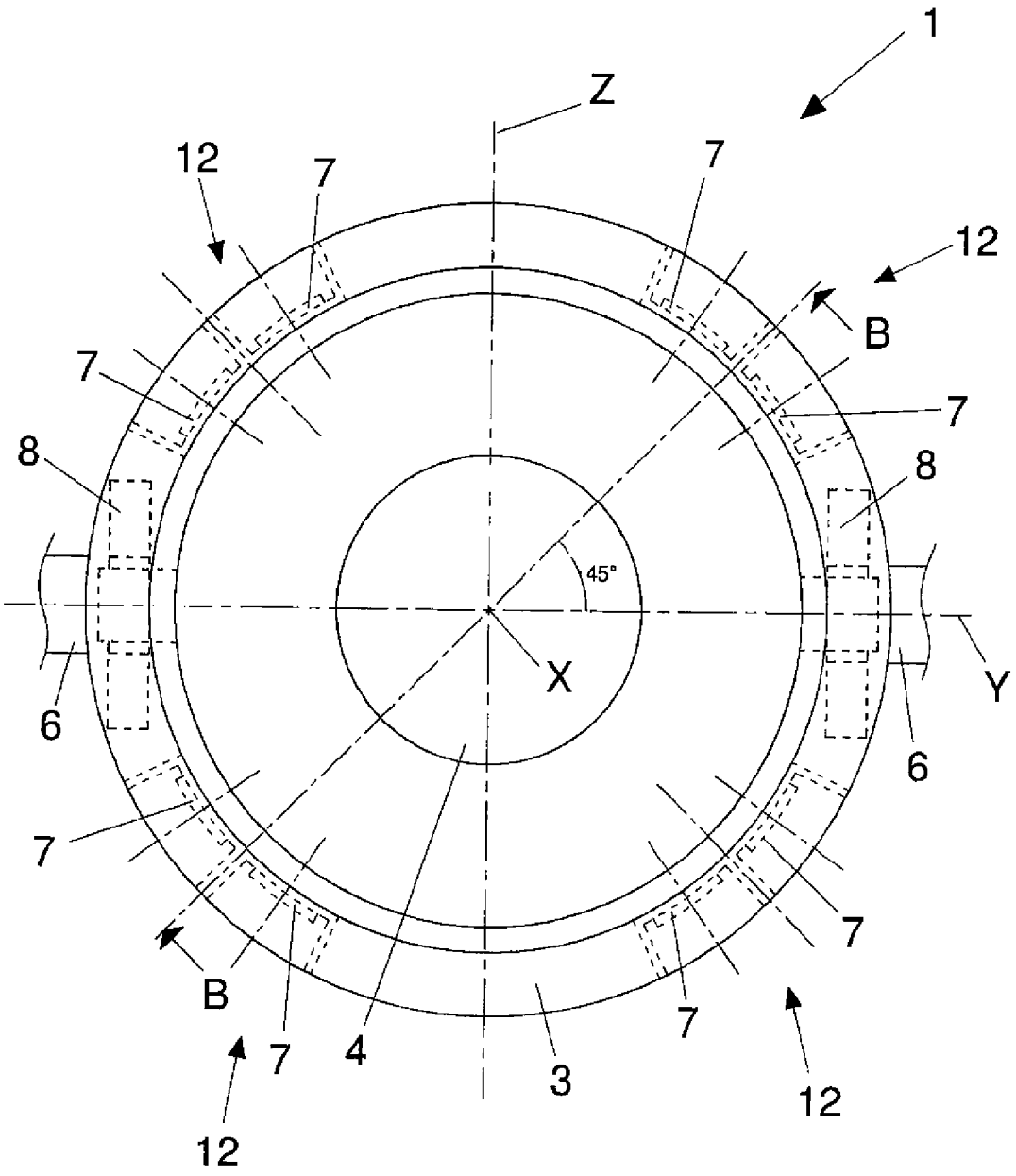
FIG. 1 shows a plan view of a converter according to the invention.

The figures show preferred embodiments of an oxygen converter, indicated as a whole by reference numeral 1.

Such a converter 1 comprises:

- a container or vessel 2, defining an axis X, provided with a loading mouth 4 of the scrap and liquid cast iron and provided with a lateral tapping hole (not shown) of the liquid steel obtained at the end of the conversion process;
- a support ring 3 for supporting the container 2, said ring 3 being arranged coaxially to the container 2 and appropriately distanced therefrom;
- two supporting pins or tilting pins 6, known as trunnions, of said support ring 3, arranged diametrically opposite to each other and defining an axis Y, orthogonal to axis X, with at least one of said supporting pins 6 connected to a tilting mechanism (not shown);
- a suspension system, which connects the container 2 to the support ring 3 and which also performs a centering function between container and ring.

A plane Y-Z, which may be considered an "equatorial" plane of the converter, and a plane X-Z, both orthogonal to the plane X-Y, are identified by defining a further axis Z as axis orthogonal to the plane X-Y passing through the intersection point of the axes X and Y.

The container 2 comprises a cylindrical central zone 20 and two frustoconical zones 21, 22, each frustoconical zone being arranged laterally with respect to said central cylindrical zone. A first frustoconical zone 21 is welded at an end thereof to said central cylindrical zone 20, while at the other end it comprises the loading mouth 4 of the container. Generally, the lateral tapping hole is provided in said first frustoconical zone 21. A second frustoconical zone 22 is welded at an end thereof to said cylindrical central zone 20, on the opposite side to the first frustoconical zone 21, while at the other end it comprises the bottom 2' of the container 2.

The support ring 3, arranged at the central zone 20 of the container 2, is hollow and preferably has a rectangular cross-section. The ring 3 has a surface 10 facing towards the part of the container comprising the loading mouth 4; a surface 11, opposite to surface 10, facing towards the part of the container 2 comprising the bottom 2' thereof an inner surface facing towards the central part of the container; an outer surface opposite to the inner surface.

With reference to figures from 1 to 4, which show the converter of the invention in the upright position thereof with the loading mouth 4 facing upwards, an advantageous embodiment of the invention includes:

- a pair of horizontal suspension devices 8, each of which being arranged at a respective supporting pin 6 and transversally with respect to the plane X-Y,
- and groups 12 of vertical suspension devices 7, said groups 12 being arranged substantially equidistant to each other, at a cylindrical side surface that is coaxial to axis X, in an intermediate position between the support ring 3 and the bottom 2'.

In the example shown in the figures, there are provided four groups 12 of vertical suspension devices 7 and each horizontal suspension device 8 is arranged between the two respective groups 12 of suspension devices 7, each group 12 being formed by two suspension devices 7. In other examples, each group 12 may be formed by three or more suspension devices 7.

The four groups 12 of suspension devices 7 are arranged at an equal angular distance between one group and the next (90°) so as to obtain a balanced distribution of the loads for each group 12 of suspension devices. The groups 12 of suspension devices 7 are arranged symmetrically with respect to plane X-Z and plane X-Y.

Advantageously, each suspension device 7 of each group 12 comprises a plurality of longitudinal elastic elements rigidly connected by means of their opposing ends to the container 2 and to the support ring 3 respectively, each longitudinal elastic element being arranged alongside the next so as to define a laying plane of the respective first suspension device, and a gap is provided between one longitudinal elastic element and the next.

In particular, each longitudinal elastic element is arranged alongside the next so as to define a single laying plane for each of said first suspension devices 7 of each group 12, and a gap is provided between one longitudinal elastic element and the next one in each of said suspension devices 7 of each group 12.

More in detail, in each group 12 of suspension devices 7, the single laying plane defined by the plurality of longitudinal elastic elements of one suspension device of said first suspension devices 7 is different from the single laying plane defined by the plurality of longitudinal elastic elements of another suspension device of said first suspension devices 7.

In a first variant (FIG. 2), the suspension devices 7 are arranged parallel to axis X and tangential to said cylindrical side surface, and also the longitudinal elastic elements 29 define a longitudinal axis thereof parallel to axis X.

Figure 2:
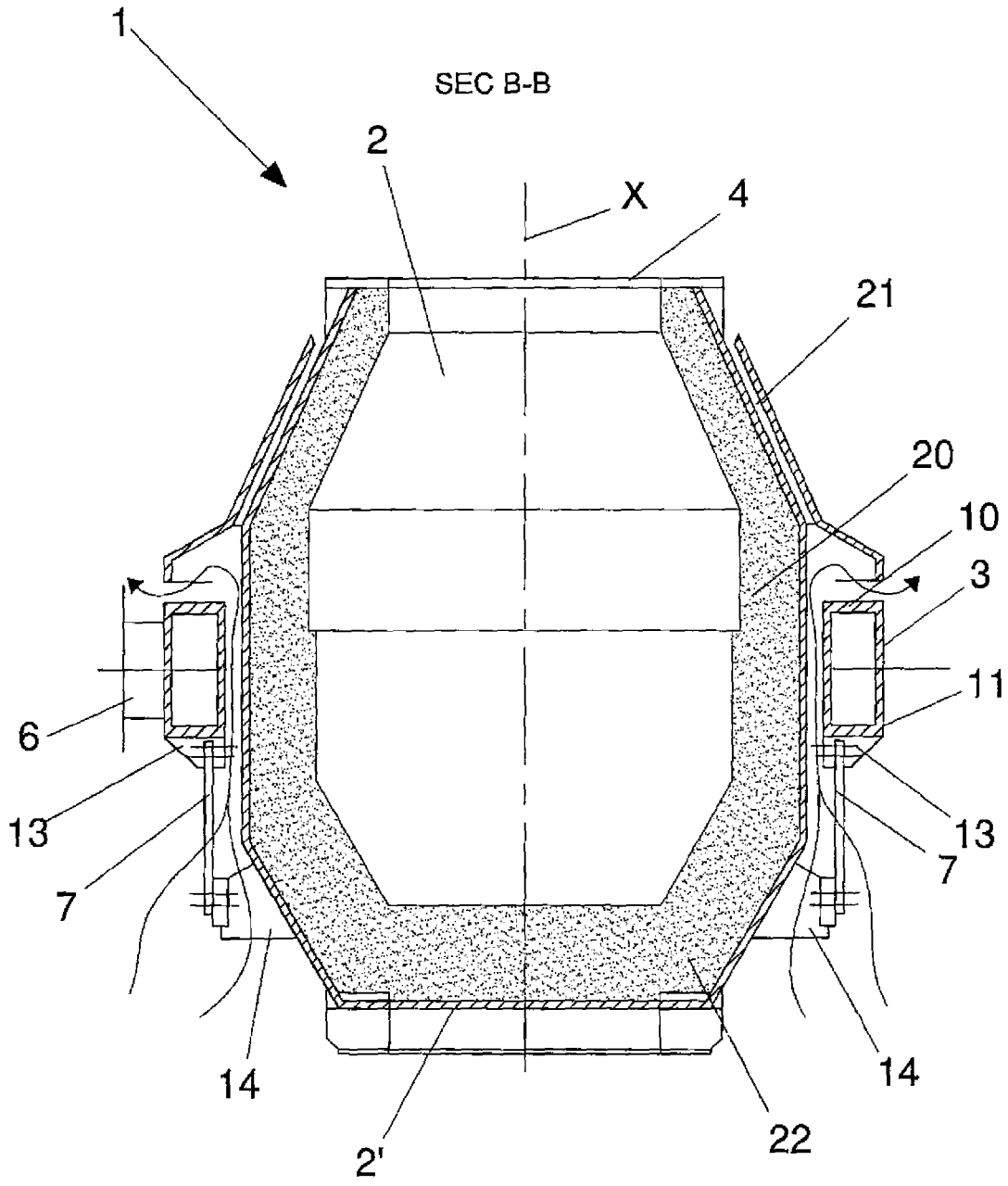
FIGS. 2 and 2*a* show a section taken along the B-B plane of two embodiments of the converter in FIG. 1.

This configuration allows a greater flow of air in the space between the suspension devices 7 and the container 2, and thus also in the space between the container 2 and the ring 3. The air flow which crosses the suspension devices 7 by virtue of the respective longitudinal passages is shown in FIG. 2.

Figure 2A:
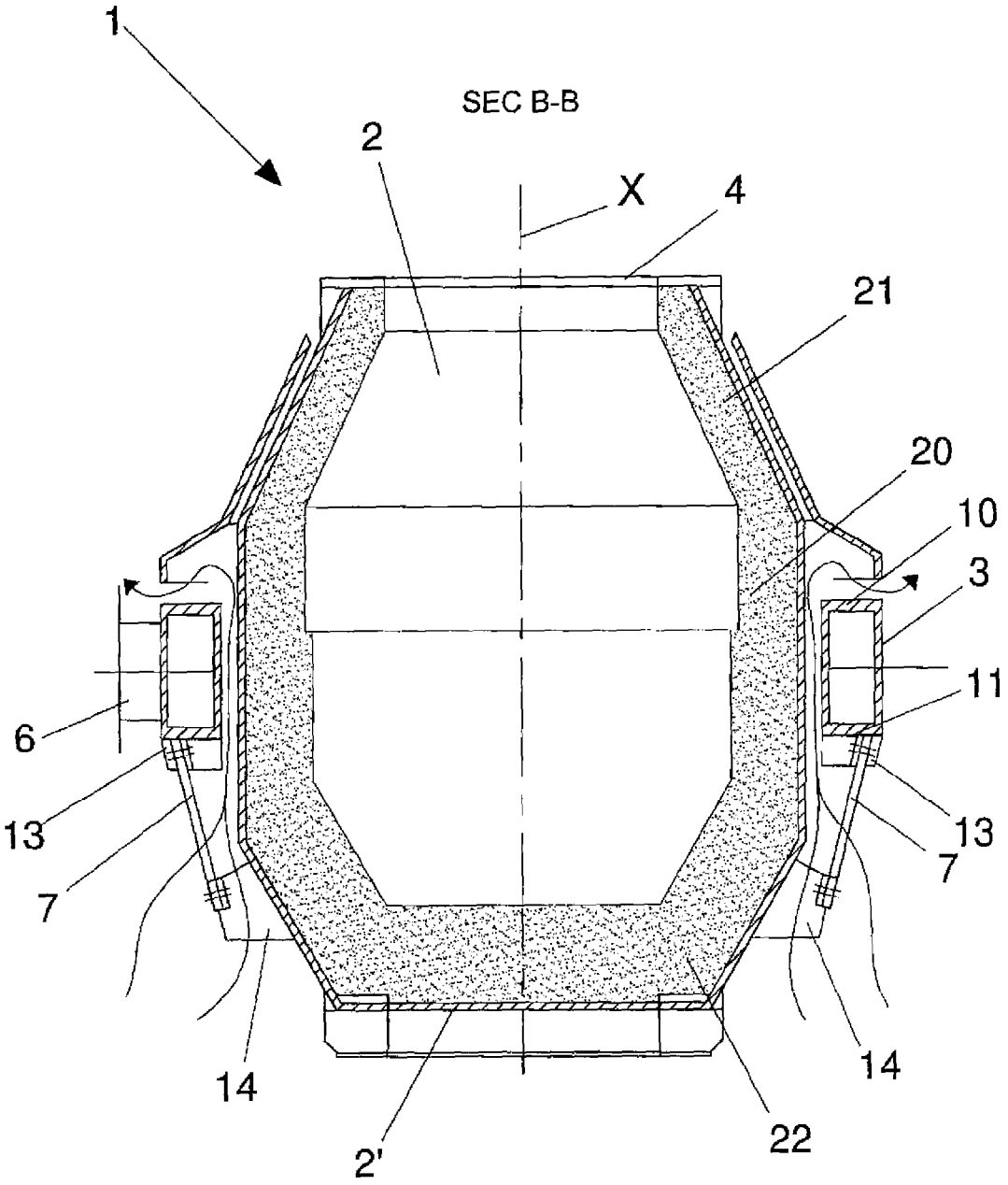

In an alternative variant (FIG. 2*a*), the suspension devices 7 are arranged inclined with respect to axis X, and also the longitudinal elastic elements 29 define a longitudinal axis thereof inclined with respect to axis X. The inclination with respect to axis X is an angle preferably comprised between 10° and 20°.

Each suspension device 7 is restrained at a first end to the container 2 and at a second end to the support ring 3 by means of locking on the respective fastening supports 13, 14, e.g. brackets, by means of fastening means, such as through screws or other equivalent means. In particular all the longitudinal elastic elements 29 of each of said first suspension devices 7 are together rigidly connected by means of a first single fastening support 13 to the support ring 3 and by means of a second single fastening support 14 to the container 2.

Advantageously, a single fastening support 13 and one only fastening support 14 may be provided to fix the ends of the suspension devices 7 of each group 12.

In particular, the fastening support 13 is integral with the surface 11 of the support ring 3, facing towards the bottom 2' of the container; while the fastening support 14 is integral with either the frustoconical zone 22 or both said frustoconical zone 22 and the bottom 2' of the container 2. In the latter case, the greater rigidity of the bottom 2', having a closed, circular structure, is exploited without the need to reinforce the cylindrical zone of the container.

Figure 3:
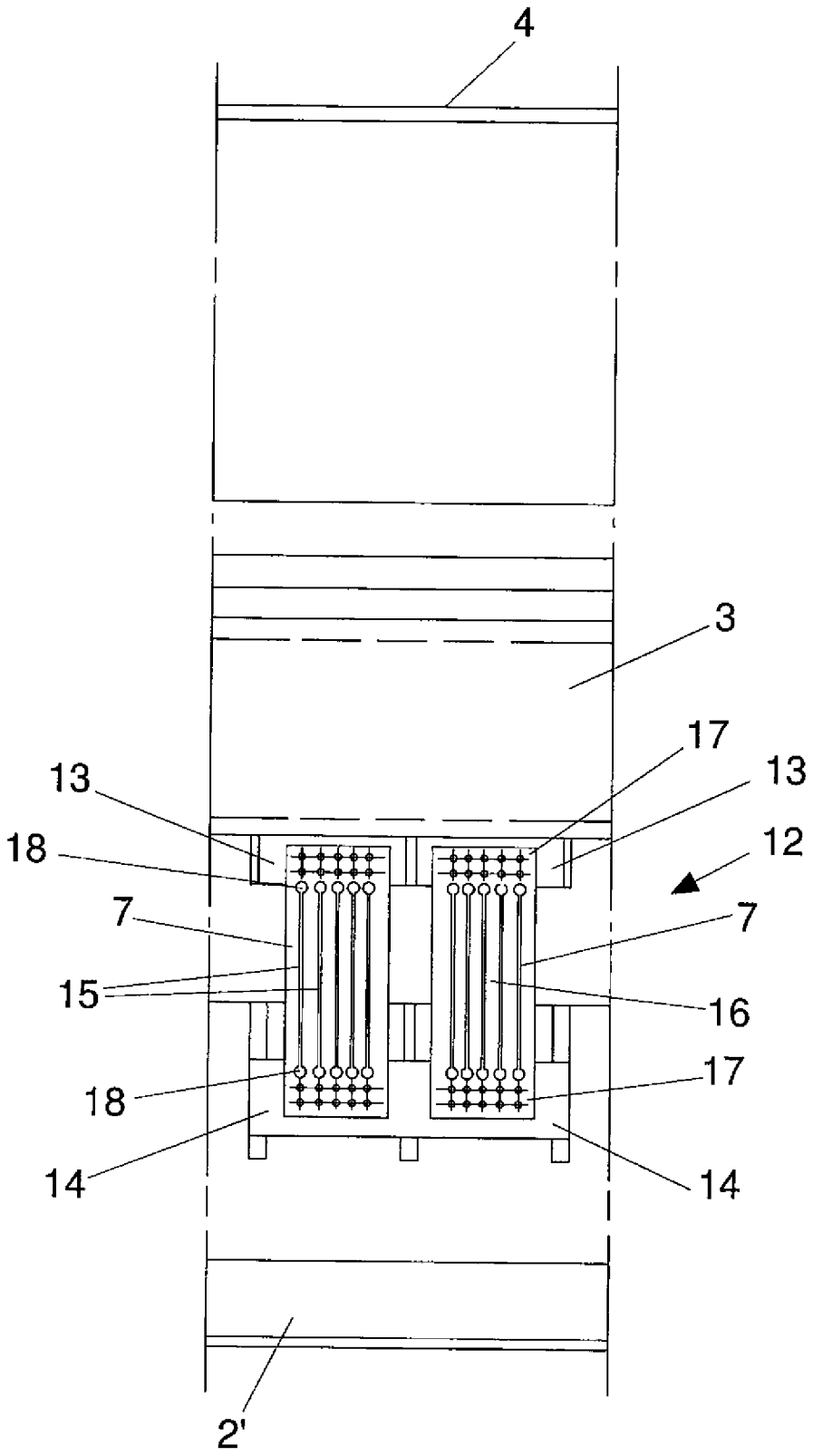
FIG. 3 shows a partial side view of the converter in FIG. 2.
Figure 5:
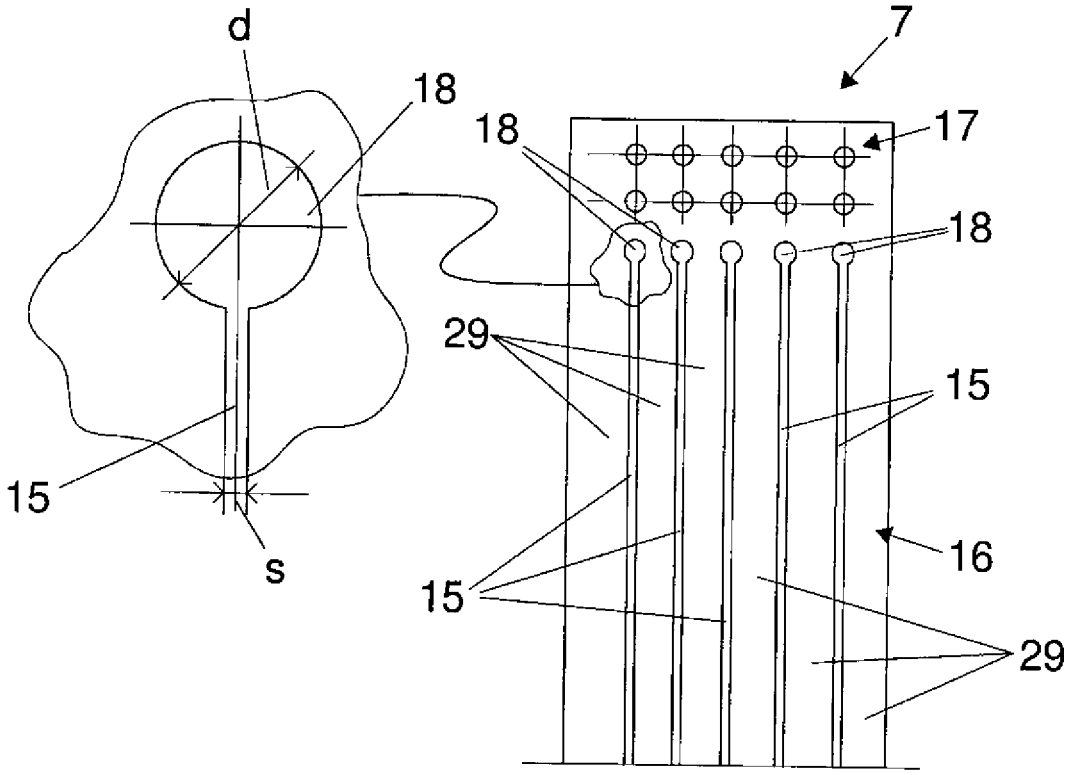
FIG. 5 shows a view of a first embodiment of a component of the converter according to the invention.

In a first embodiment of the invention, shown in FIGS. 3 and 5, the gaps between the longitudinal elastic elements 29 are defined by respective longitudinal notches 15 passing through thickness of a flat plate defined by the union of said longitudinal elastic elements 29 arranged alongside to each other. Each suspension device 7 is a rectangular-shaped flat plate with rectangular cross-section. The longitudinal notches 15 are obtained in a central zone 16 of the flat plate, intermediate with respect to the ends 17 fixed, e.g. by means of through screws, to the fastening supports 13, 14.

Each flat plate is provided with a circular hole 18 at each end of the longitudinal notches 15. The circular holes 18 communicate with the respective end of the longitudinal notch 15 and, preferably, have a diameter "d" of value equal to at least ten times the width "s" of the longitudinal notches 15. Preferably, the width "s" is comprised in the 1-5 mm range, e.g. 2 mm, and the diameter "d" is comprised in the 10-40 mm range, e.g. 30 mm. Said circular end holes, made using a machine tool, eliminate the end stresses of the notches due to the stresses induced on the suspensions.

Figure 6:
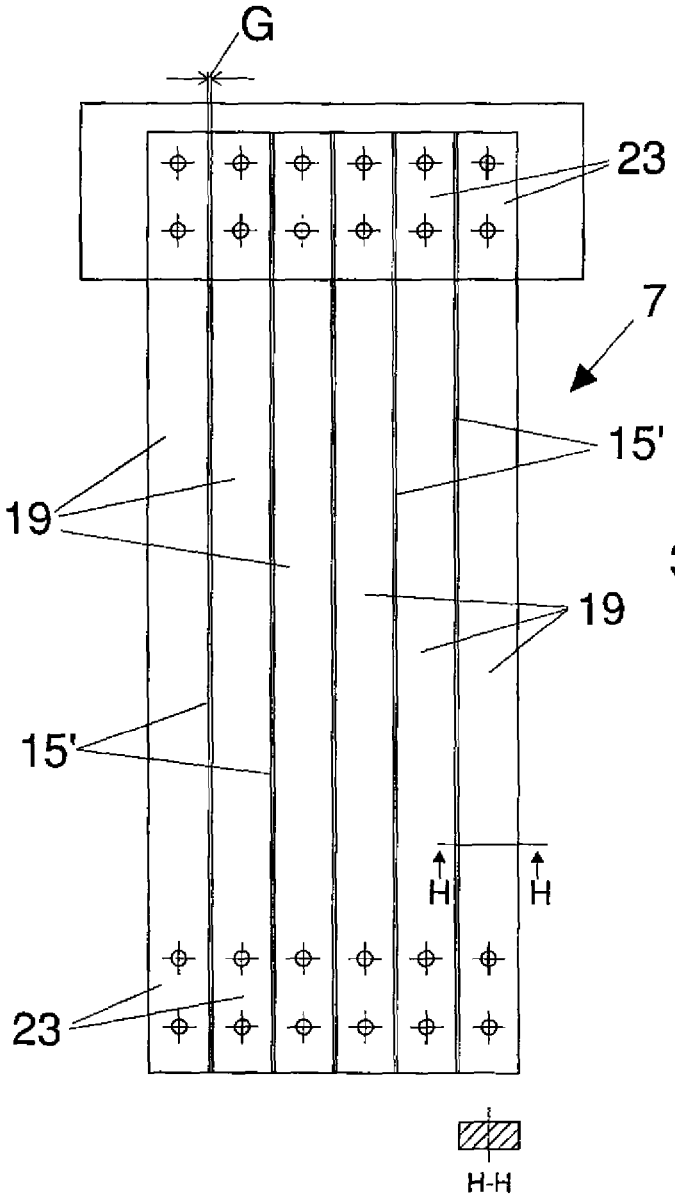
FIG. 6 shows a view of a second embodiment of the component in FIG. 5.

In a second embodiment of the invention, shown in FIG. 6, the gap 15' between one longitudinal elastic element 19 and the next extends for the entire longitudinal extension of said longitudinal elastic elements 19.

The longitudinal elastic elements 19 are flat and have a rectangular transversal section. The ends 23 of each longitudinal element 19 are fixed, for example by means of through screws, to the fastening supports 13, 14. In particular, all the longitudinal elastic elements 19 of each of said first suspension devices 7 are together rigidly connected by means of a first single fastening support 13 to the support ring 3 and by means of a second single fastening support 14 to the container 2.

Advantageously, this solution is the most cost-effective because it allows to use commercial rolled products, no further machining operations are needed and steel with high mechanical properties may be used.

Figure 7:
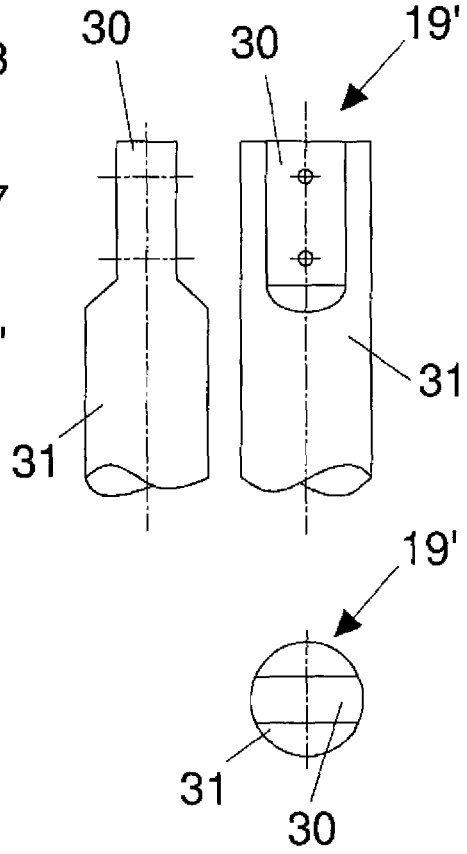
FIG. 7 shows a view of a third embodiment of the component in FIG. 5.

In a third embodiment of the invention (not entirely shown), similar to said second embodiment, the gap 15' between one longitudinal elastic element 19' (FIG. 7) and the next extends for the entire longitudinal extension of said longitudinal elastic elements 19'.

In this variant, the longitudinal elements 19' have flat ends 30 having rectangular transversal section and a central body 31 having circular transversal section. Said central body 31 has a diameter greater than the width of the ends 30. The ends 30 of each longitudinal element 19' are fixed, for example by means of through screws, to the fastening supports 13, 14. In particular, all the longitudinal elastic elements 19' of each of said first suspension devices 7 are together rigidly connected by means of a first single fastening support 13 to the support ring 3 and by means of a second single fastening support 14 to the container 2.

This solution is similar to the previous one but each longitudinal element is obtained from a rolled rod instead of having a rectangular cross-section.

The horizontal suspension devices 8 instead are arranged parallel to the plane Y-Z, orthogonal to the first axis X, and symmetric to the plane X-Z. The suspension devices 8 cross the plane X-Y and are arranged near the surface 10 and/or the surface 11 of the support ring 3.

Figure 4:
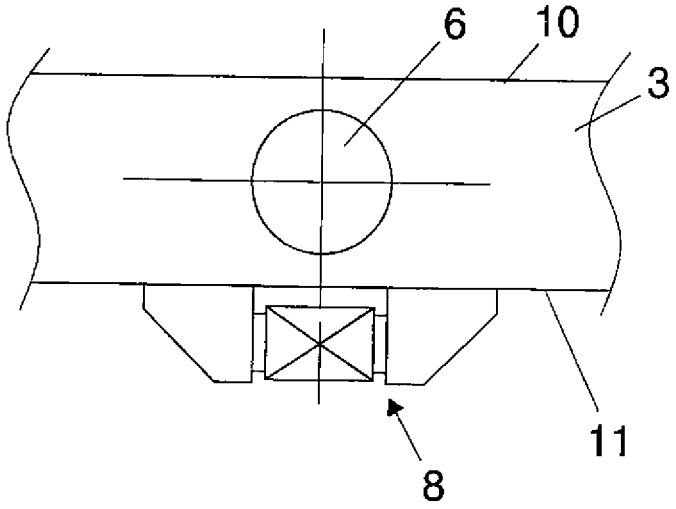
FIG. 4 shows a partial side view of the converter in FIG. 1.

In a first preferred variant, the suspension devices 8 are arranged at a first side of the plane Y-Z, i.e. under the plane Y-Z and the support ring 3 when the converter is in the upright position (FIG. 4). In this case, the suspension devices 8 are advantageously arranged closer to the centre of gravity of the converter to support the load when it is in horizontal position (tapping position).

In a second variant (not shown), the suspension devices 8 are arranged instead at a second side of the plane Y-Z, i.e. above the plane Y-Z and the support ring 3. In a third variant (not shown), two pairs of horizontal suspension devices 8 are provided, a first pair being arranged at a first side of the plane Y-Z and a second pair being arranged at a second side of the plane Y-Z.

The two supporting pins 6, actuated by at least one tilting mechanism, allow the rotation of the converter about axis Y.

The converter usually passes from a first position, in which it is in its vertical position with the loading mouth 4 facing upwards (FIG. 2), to a second position inclined by approximately 30° with respect to the vertical 40, by means of a rotation of the supporting pins 6 in a sense of rotation. In this second position, the liquid cast iron and scrap are loaded through the mouth 4.

The converter returns to the first position in FIG. 2 after loading. One or more nozzles, introduced into the container through the mouth 4, blow oxygen for a given period of time so as to drastically lower the carbon content and reduce the concentration of impurities, such as sulfur and phosphorus.

Once the conversion into liquid raw steel has been completed, the converter passes from the first position shown in FIG. 2 to a third position inclined by approximately 90° with respect to the vertical, by rotating the supporting pins 6 in said sense of rotation. In this third position, the liquid steel is tapped through the tapping hole provided in the container of the converter.

In all variants of the invention, illustrated in the figures, the load, determined by the sum of the weights of the container 2, the liquid cast iron and the scrap, is relieved onto the ground by means of the support ring 3, the vertical suspension devices 7, the horizontal suspension devices 8, the tilting pins 6 and the related supports.

In particular, the configuration of the suspension devices 7 and of the suspension devices 8 allows to absorb the weight at any inclination of the container 2.

The suspension devices 7 act exclusively as tie-rods for an inclination angle of the converter with respect to the vertical equal to 0°, while they act only as struts for an inclination angle equal to 180°, and gradually both as tie-rods and as struts for different angles from 0° and 180°.

The position with inclination angle equal to 180°, with the loading mouth 4 facing downwards, is provided for cleaning operations of the container once emptied.

The suspension devices 8 guarantee an optimal support, stability and rigidity of the container. The main purpose of the suspension devices 8 is to support the weight of the container in direction transversal to axis Y when it is inclined by 90° (tapping position) and to support the load component orthogonal to axis X of the converter in all other conditions.

In general, therefore, the load on the suspension devices 7 gradually passes from a maximum value with converter in vertical position to a minimum value with converter in horizontal position, while the load on the suspension devices 8 passes gradually from a value substantially equal to zero to a maximum value when the converter passes from the horizontal position to the vertical position.

The moments which are generated with the rotation of the converter about axis Y are perfectly absorbed by the configurations of the suspension devices 7 and the suspension devices 8.

Various type of the horizontal suspension devices 8 already known in the prior art may be used in the converter object of the present invention.

A first example of suspension device 8, described in WO9525818, has a first structure welded to the container 2 and a second T-shaped structure bolted to the support ring 3. A shim, which allows to adjust the two structures during the step of assembling, is provided at the interface of the welded structure to the container and the T-shaped structure fixed to the ring.

A second example of suspension device 8, described in U.S. Pat. No. 3,653,648, has a first anchor fixed to the container 2 and a second anchor fixed directly to the supporting ring 3. A wedge-shaped shim, fixed in turn by means of screws during the step of assembling of the converter, is provided at the interface between the two anchors, allowing an adjustment of the suspension device exclusively during the step of assembling of the converter.

What is claimed is:

1. A tilting converter comprising:

a container, defining a first longitudinal axis X, having a bottom;

a support ring, coaxial to the container and distanced from said container, provided with two diametrically opposite supporting pins, defining a second axis Y orthogonal to the first axis X, adapted to allow a rotation of the converter about said second axis Y;

a suspension system, connecting said container to said support ring, comprising groups of first suspension devices, said groups being arranged substantially equidistant to each other at a cylindrical side surface coaxial to the first axis X, in a position between the support ring and the bottom, characterised in that each of said first suspension devices is provided with a plurality of longitudinal elastic elements rigidly connected by means of their opposing ends to the container and to the support ring respectively, each longitudinal elastic element being arranged alongside the next so as to define a single laying plane for each of said first suspension devices of each group, and a gap is provided between one longitudinal elastic element and the next one in each of said suspension devices of each group;

wherein the gap between a longitudinal elastic element and the next is defined by a longitudinal notch passing through the thickness of a flat plate defined by the union of said longitudinal elastic elements arranged alongside, the longitudinal notches being obtained in a central area of said flat plate.

2. A converter according to claim 1, wherein, in each group, the laying plane defined by the plurality of longitudinal elastic elements of one suspension device of said first suspension devices is different from the laying plane defined by the plurality of longitudinal elastic elements of another suspension device of said first suspension devices.

3. A converter according to claim 1, wherein each of said first suspension devices is parallel to the first axis X and tangential to said cylindrical side surface.

4. A converter according to claim 3, wherein said longitudinal elastic elements are parallel to the first axis X.

5. A converter according to claim 1, wherein each of said first suspension devices (7) is inclined with respect to the first axis X.

6. A converter according to claim 5, wherein said longitudinal elastic elements are inclined with respect to the first axis X.

7. A converter according to claim 1, wherein said first suspension devices are restrained at a first end to the container and at a second end to the support ring, preferably by means of locking on respective fastening supports.

8. A converter according to claim 7, wherein all the longitudinal elastic elements of each of said first suspension devices are together rigidly connected by means of a first single fastening support to the support ring and by means of a second single fastening support to the container.

9. A converter according to claim 7, wherein a first fastening support to the support ring is integral with a first surface of the support ring, facing the bottom of the container.

10. A converter according to claim 1, wherein each flat plate is provided with a circular hole at each end of the longitudinal notches.

11. A converter according to claim 10, wherein the circular holes communicate with the respective longitudinal notch and, preferably, have a diameter equal to a value at least ten times the width of the longitudinal notches.

* * * * *